US005546166A

United States Patent [19]

Hirota et al.

[11] Patent Number: 5,546,166

[45] Date of Patent: Aug. 13, 1996

[54] IMAGE FORMING APPARATUS WITH AUTO-CLEAR FUNCTION

[75] Inventors: Masaya Hirota; Hiroyuki Ideyama; Toru Okatani; Toshiyuki Yamashita; Hideo Ito; Yoichi Kawabuchi, all of Osaka, Japan

[73] Assignee: Minolta Camera Kabushiki Kaisha, Osaka, Japan

[21] Appl. No.: 3,142

[22] Filed: Jan. 12, 1993

[30] Foreign Application Priority Data

Jan. 13, 1992 [JP] Japan ..... 4-003811

[51] Int. Cl.[6] ..... G03G 15/00

[52] U.S. Cl. ..... 355/209; 355/205

[58] Field of Search ..... 355/203, 205, 355/206, 207, 209, 204, 313, 40; 371/5.1, 61; 340/853.2, 500, 825.06, 825.54

[56] References Cited

U.S. PATENT DOCUMENTS

| | | | |
|---|---|---|---|
| 4,222,660 | 9/1980 | Furuichi et al. | 355/55 X |
| 4,682,158 | 7/1987 | Ito et al. | 340/679 |
| 4,711,556 | 12/1987 | Abuyama | 355/209 X |
| 4,799,081 | 1/1989 | Kikuno et al. | 355/209 X |
| 4,819,575 | 4/1989 | Maruta et al. | 355/208 |
| 4,845,527 | 6/1989 | Maruta et al. . | |
| 4,857,957 | 8/1989 | Kusumoto | 355/314 |
| 4,952,988 | 8/1990 | Furuichi et al. | 355/209 |
| 5,182,597 | 1/1993 | Masuda et al. | 355/205 |

*Primary Examiner*—Thu Anh Dang
*Attorney, Agent, or Firm*—Price, Gess & Ubell

[57] ABSTRACT

An image forming apparatus capable of making copies under either predetermined standard copy conditions or copy conditions optionally set by an operator. After the final key input, or at the completion of a copying process, a first timer is set to count a predetermined time period. When the first timer finishes counting, the copy conditions are automatically set to the standard conditions. The above apparatus is provided with a guidance mode for the purpose of explaining the method for setting the functions and copy conditions within the apparatus to an inexperienced operator. In the case where the guidance mode is set by the operator, a second timer is set to count a predetermined time period longer than the time period counted by the first timer. When the second timer finishes counting, the copy conditions are automatically set to the standard conditions.

24 Claims, 8 Drawing Sheets

IMAGE FORMING APPARATUS WITH AUTO-CLEAR FUNCTION

BACKGROUND OF THE INVENTION

1. Field of the Invention

The present invention relates to an image forming apparatus with auto-clear function.

2. Description of the Related Art

Heretofore, when an operator sets the copying conditions to other than the standard conditions, e.g., when the enlargement mode is set, the copying conditions may not be reset to the standard conditions after the copying process, so that when the next operator proceeds with a copying process believing the copying conditions are set at the standard conditions, said copying process will be executed under the enlargement mode set by the previous operator, thereby resulting in an error. The present invention provides a copying apparatus with an auto-clear function to eliminate errors of the aforesaid type.

In a copying apparatus with an auto-clear function, after the final key input, or at the completion of a copying process, an auto-clear timer is set to count a predetermined time period. When the aforesaid auto-clear timer has completed the count of said predetermined time period, the copy conditions are automatically set to the standard conditions. If there is any key input during the period wherein the auto-clear timer is counting, the auto-clear timer is restarted.

In recent years, copying apparatus have become more complex due to the methods for setting functions and copying conditions within the apparatus, and therefore have been provided with a guidance mode (also called "help function" and "instructions"). A guidance key and guidance screen are provided on the operation panel of the copying apparatus with a guidance mode. When an inexperienced operator depresses the guidance key, the guidance mode is set, and descriptions of the methods for setting the functions and copy conditions within the copying apparatus are displayed on the guidance screen. An operator can verify and gain an explanation of the methods for setting the functions and copy conditions within the copying apparatus by means of the aforesaid guidance display.

When an operator uses the guidance mode, a certain amount of time is required to read and understand the methods for setting the functions and copy conditions within the copying apparatus which are displayed on the guidance screen. In conventional copying apparatus, the time counted by the auto-clear timer is set, for example, so as to be not longer than 30 to 45 seconds. Therefore, when the methods for setting complex functions are displayed for an operator, the auto-clear function may operate and clear the guidance display while the operator is still reading the contents of said display, resulting in inconvenience.

Since the auto-clear function operates suddenly without prior input, an operator cannot be aware of the timing of the operation of the auto-clear function. Accordingly, such a method has an inherent disadvantage inasmuch as the auto-clear function may operate and clear the guidance mode while an operator is still reading the contents displayed on the guidance screen. This disadvantage may also occur after an operator changes the copy conditions to settings other than the standard copy conditions to make copies, and a next operator unknowingly starts a copying process using the copy conditions set by the previous operator. That is, a copy error occurs when the auto-clear function operates immediately before a next operator depresses the print key.

SUMMARY OF THE INVENTION

A main object of the present invention is to provide an image forming apparatus capable of proper operation without causing operator confusion.

Another object of the present invention is to provide an image forming apparatus capable of displaying for an operator the copy condition setting methods and operation methods for an adequate time to allow operator comprehension.

A still further object of the present invention is to provide an image forming apparatus capable of alerting an operator of the timing for the operation of the auto-clear function which automatically returns the copy conditions to the standard copy conditions after completion of a copy operation, or within a predetermined time period following any key operation.

The aforesaid objects of the present invention are accomplished by providing an image forming apparatus as described below.

An image forming apparatus capable of making copies under either predetermined standard copy conditions or copy conditions optionally set by an operator, said image forming apparatus comprising:

first setting means for setting copy conditions other than the standard copy conditions;

first counting means for counting a predetermined time period after the completion of a copying operation or after copy conditions have been set by the first setting means;

return means for automatically returning the copy conditions to the standard copy conditions when any operation has not been performed by the operator before the first counting means finishes counting;

second setting means for setting a guidance mode for explaining the copy condition setting methods and operating methods to an operator;

display means for displaying the copy condition setting methods and operating methods in accordance with the set guidance mode;

second counting means for counting a predetermined time period after the guidance mode is set by said second setting means, and wherein said time period counted by the second counting means is different than the time period counted by said first counting means; and cancel means for cancelling the guidance mode when the second counting means finishes counting.

The aforesaid objects of the present invention may also be achieved by providing an image forming apparatus as described below.

An image forming apparatus capable of making copies under either predetermined standard copy conditions or copy conditions optionally set by an operator, said image forming apparatus comprising:

setting means for setting copy conditions different from the standard copy conditions;

counting means for counting a predetermined time period after the completion of a copying operation or after copy conditions have been set by the setting means;

return means for automatically returning the copy conditions to the standard copy conditions when any operation has not been performed by the operator before the counting means finishes counting;

warning means for warning the operator that the return means is about to operate a predetermined time period before the counting means finishes counting.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
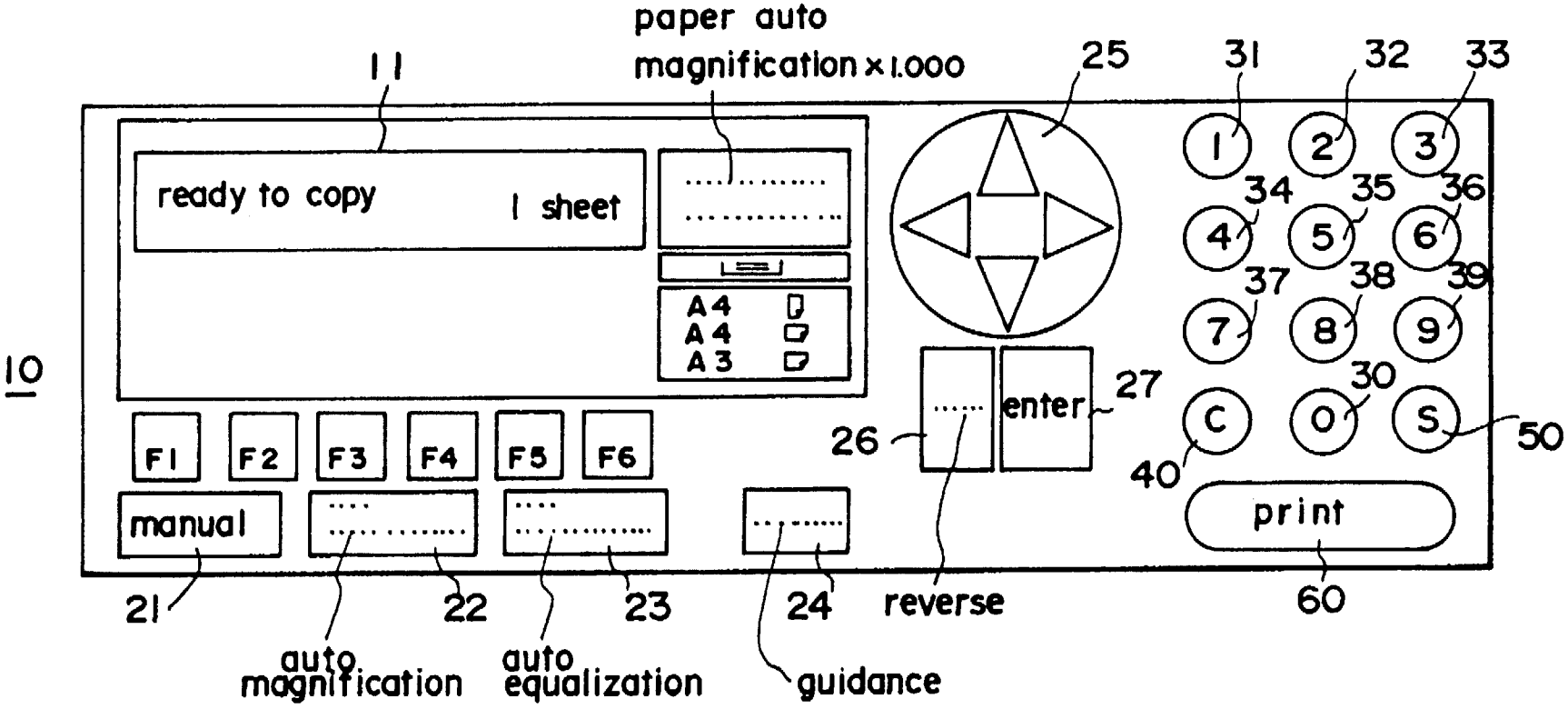
FIG. 1 shows the operation panel provided on the copying apparatus of the present invention.

The copying apparatus of the present invention is provided with an auto-clear function and guidance mode function. Since the construction and functions of the copying apparatus itself are well known, explanations of said construction and functions are omitted from the following description. An operation panel 10, such as that shown in FIG. 1, is provided on the top of the copying apparatus body. The operation panel 10 is provided with a liquid crystal display (LCD) screen 11, which is constructed so that the display of said LCD screen 11 changes successively in accordance with the various modes. The operation panel 10 is provided with function keys F1~F6 for changing the functions via the screens displayed on the LCD screen 11, manual key 21 for operator selection of copy paper, magnification and switching copy modes, auto-variable magnification key 22 for automatically setting the magnification and switching copy modes after detection of the size of an original when an operator has selected the copy paper size, auto-equal magnification key 23 for switching the mode for automatically selecting the copy paper size suitable for the size of the original, and guidance key 24 for displaying a description of the present mode. The aforesaid guidance key 24 is constructed such that each time the guidance key 24 is depressed, the next guidance display in the guidance mode is displayed on the LCD screen 11. When depressed several times, the aforesaid guidance displays appear in rotation and return to the original standard mode screen (refer to FIG. 6).

Figure 2:
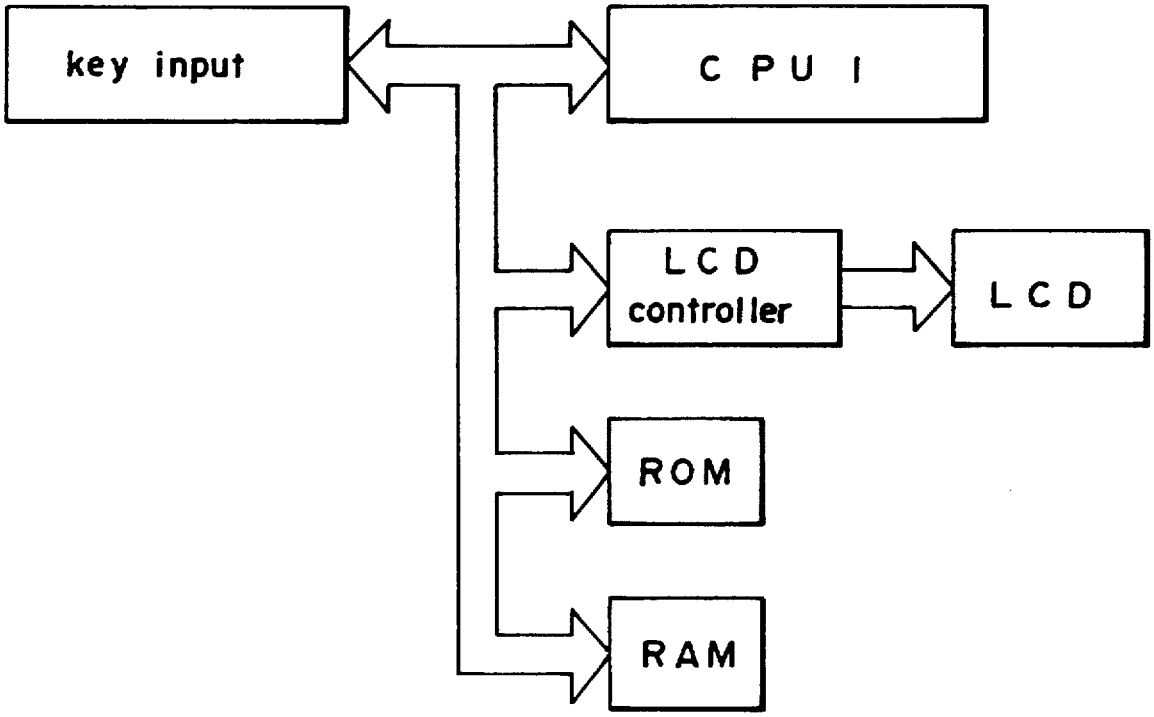
FIG. 2 is an illustration showing the central processing unit (CPU) block of the copying apparatus of the present invention.

At the right side of the LCD screen 11 are provided a cursor key 25 for moving the cursor vertically and horizontally to select a mode on the LCD screen 11, reverse key 26 for returning to the immediately previous screen of the LCD screen 11, enter key 27 for defining the mode selected on the LCD screen 11, ten-key pad keys 30–39 for setting the number of copies, clear key 40 for clearing the number of copies set by ten-key pad keys 30–39, stop key 50 for stopping the copy process, and print key 60 for starting the copy process. The signals input via the aforesaid keys provided on the operation panel 10 are transmitted to the CPU shown in FIG. 2, and the LCD screen 11 display controls and copy controls are executed by said CPU.

Figure 3:
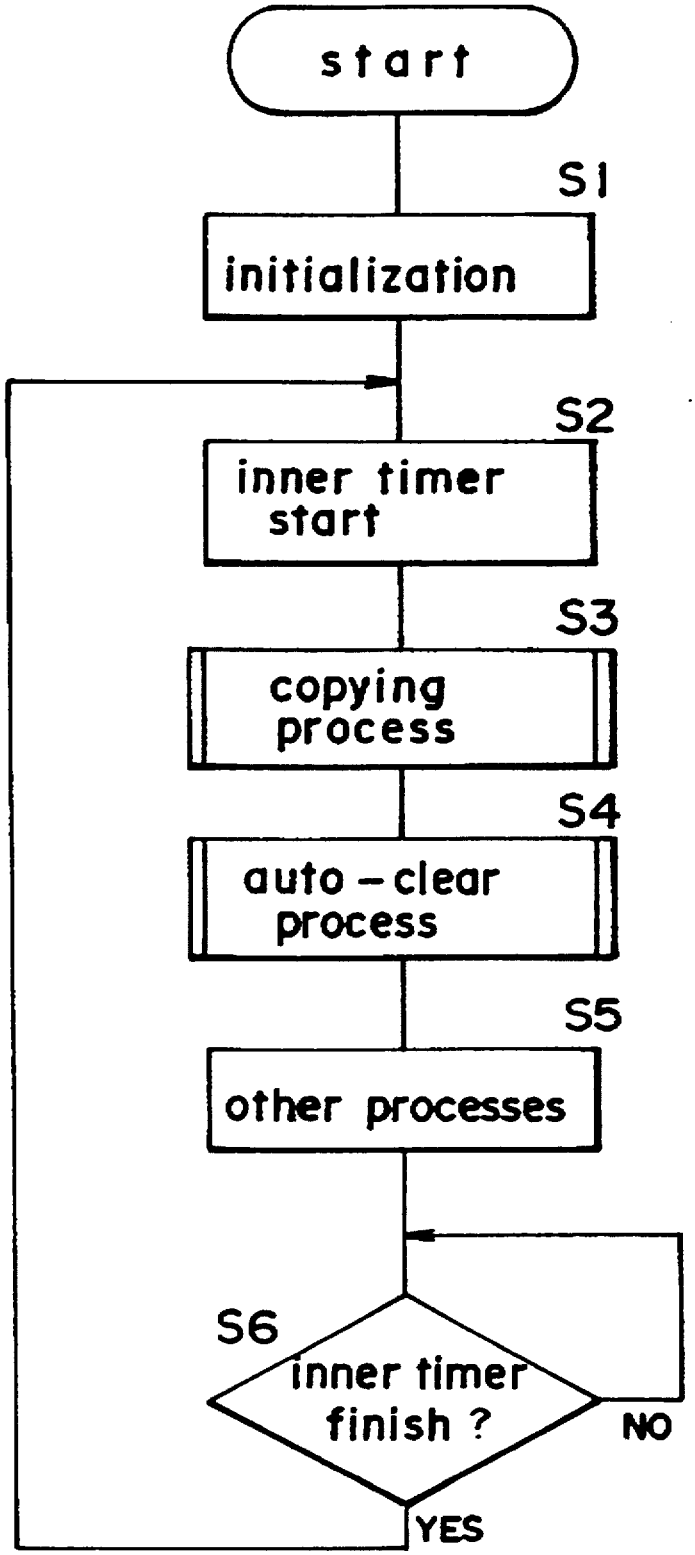
FIG. 3 is a main flow chart of the copying apparatus of the present invention.

The flow chart of the main routine of the CPU is described hereinafter with reference to FIG. 3. In the flow chart, initialization is executed in step S1. Then, in step S2, internal timers are set automatically to set the time period of one routine required to execute the various controls. Thereafter, a copy process (step S3) for key input from the operation panel 10, auto-clear process (step S4) corresponding to said key input, and other processes (step S5) are executed, and after the end of the internal timer is detected in step S6, the routine returns to step S2.

Figure 4:
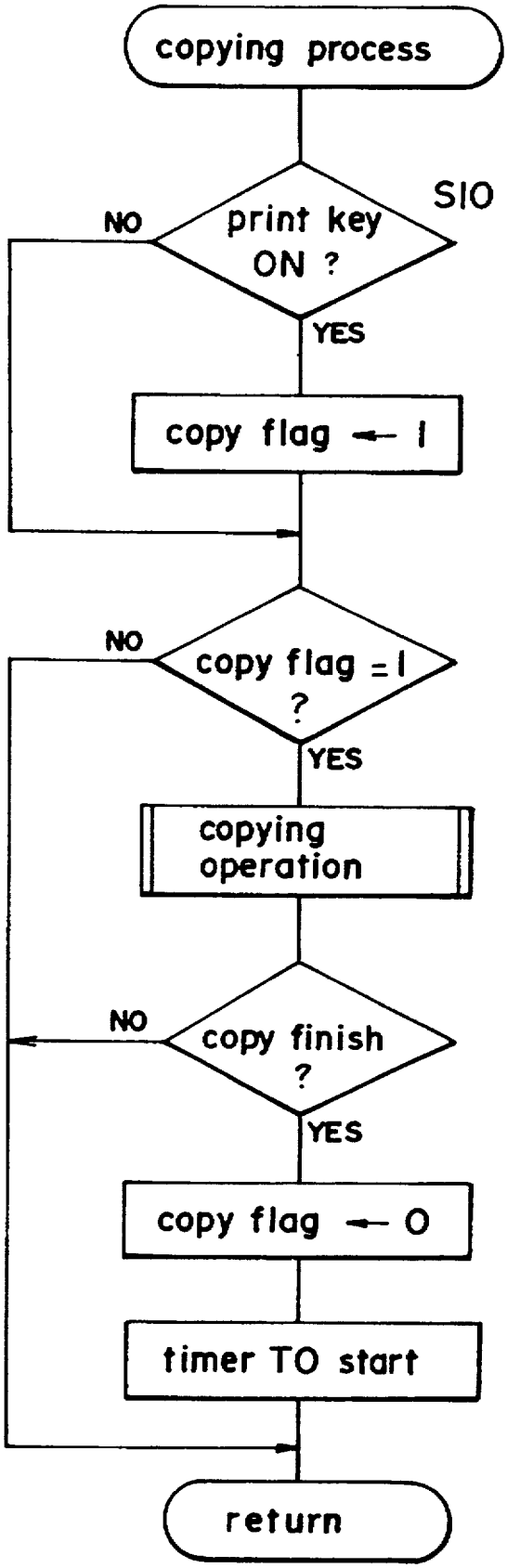
FIG. 4 shows the subroutines of the copying operation process of the copying apparatus of the present invention.

The subroutine of the copy process is described hereinafter with reference to FIG. 4. First, a check is made in step S10 to determine whether or not the print key 60 is ON. If the print key 60 is ON, the routine continues and an operation is executed to set the copy flag at [1] in step S11, then a check is made in step S12 to determine whether or not the copy flag is set at [1]. If the copy flag is found to not be set at [1] in step S12, the routine returns to the main routine. However, if the copy flag is determined to be set at [1] in step S12, the routine advances to step S13 and a copy operation is executed. In step S14 a check is made to determine the copy finish timing. When it is determined that the copy is finished in step S14, the copy flag is set at [0] in step S15, and the normal auto-clear timer T0 is set in step S16. When it is determined in step S14 that the copy is not finished, the routine returns to the main routine.

Figure 5A:
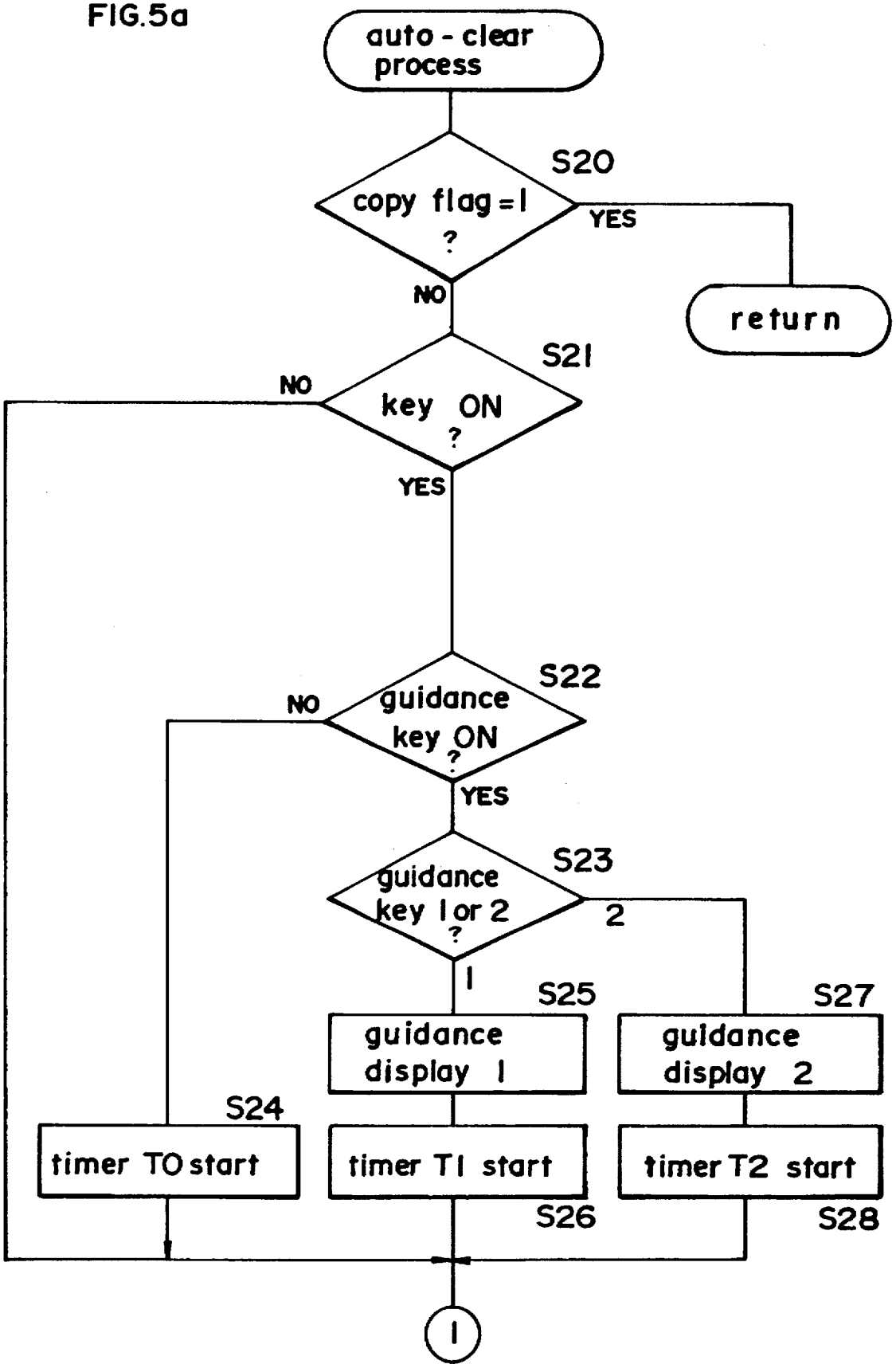
FIGS. 5*a* and 5*b* show the subroutine of the auto-clear process of the copying apparatus of the present invention.
Figure 5B:
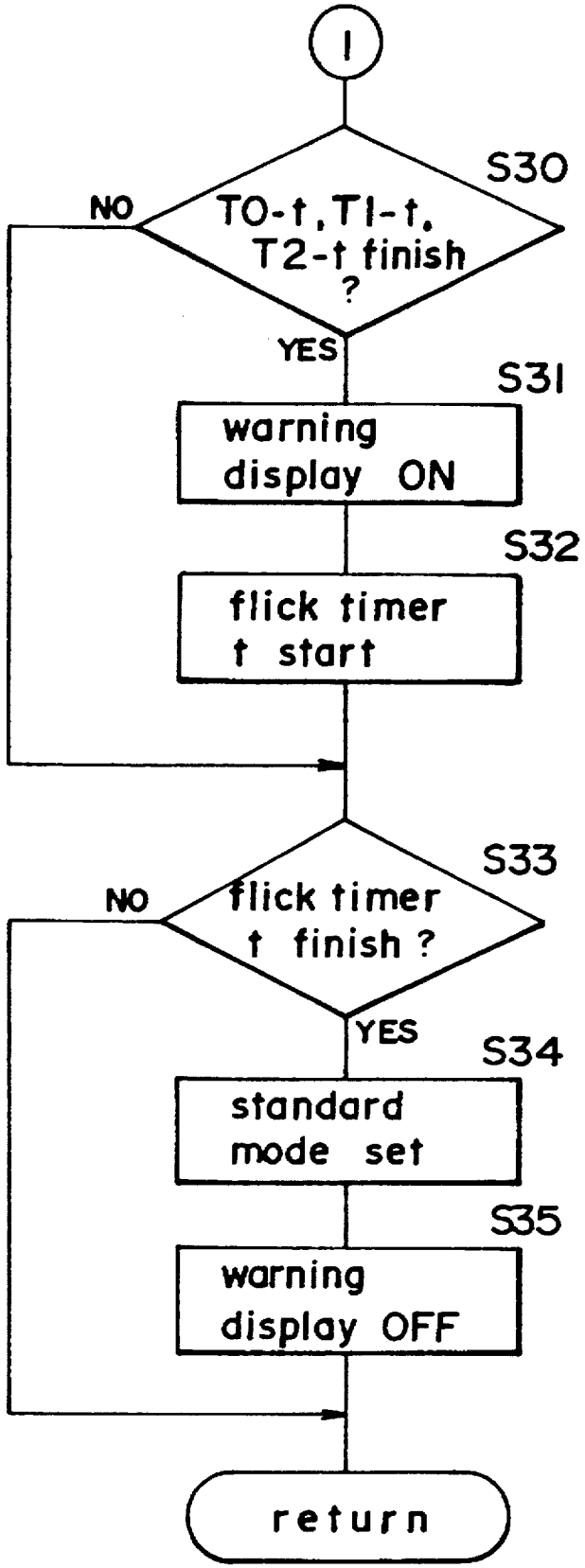

The auto-clear process subroutine is described hereinafter with reference to FIGS. 5*a* and 5*b*. A check is made in step S20 to determine whether or not the copy flag is set at [1]. When it is determined that the copy flag is set at [1], the routine returns to the main routine, whereas when it is determined that the copy flag is not set at [1], the routine advances to step S21. A check is made in step S21 to determine whether or not there is a key input. When it is determined that there is not a key input, the routine advances to step S30, whereas when it is determined that there is key input, the routine continues to step S22 where a check is made to determine whether or not said key input is a guidance key 24 input. If it is determined in step S22 that the key input is not a guidance key 24 input, the routine advances to step S24, and the normal length auto-clear timer T0 is started. On the other hand, when it is determined in step S22 that the input is a guidance key 24 input, the routine continues to step S23. In step S23, a check is made to determine whether or not the guidance key input is 1 or 2. When the guidance input is determined to be 1, the guidance display 1 is displayed on the LCD screen 11 (refer to FIG. 6*a*) in step S25, and the auto-clear timer T1, which is shorter than the auto-clear timer T0, is started in step S26. When the guidance is determined to be 2 in step S23, the routine advances to step S27 and the guidance display 2 is displayed on the LCD screen 11 (refer to FIG. 6*b*), and the auto-clear timer T2, which is longer than the auto-clear timer T0, is started in step S28.

Figure 6A:
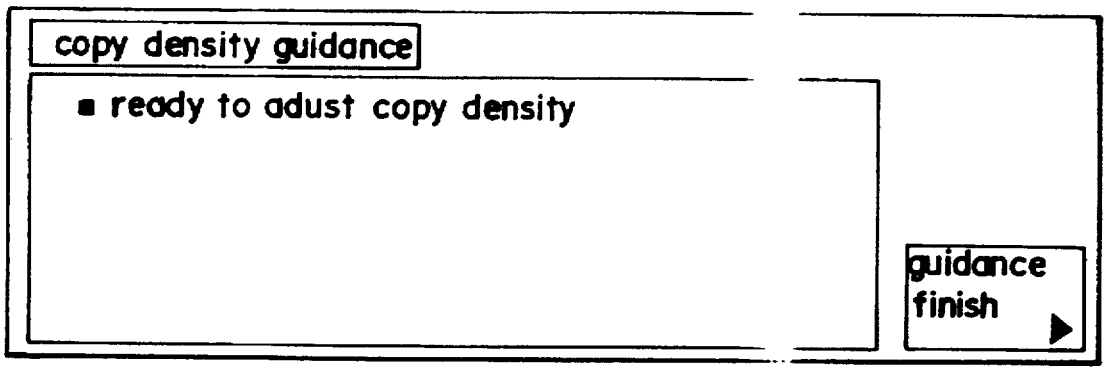
FIG. 6*a* shows an example of a screen for the guidance display 1.
Figure 6B:
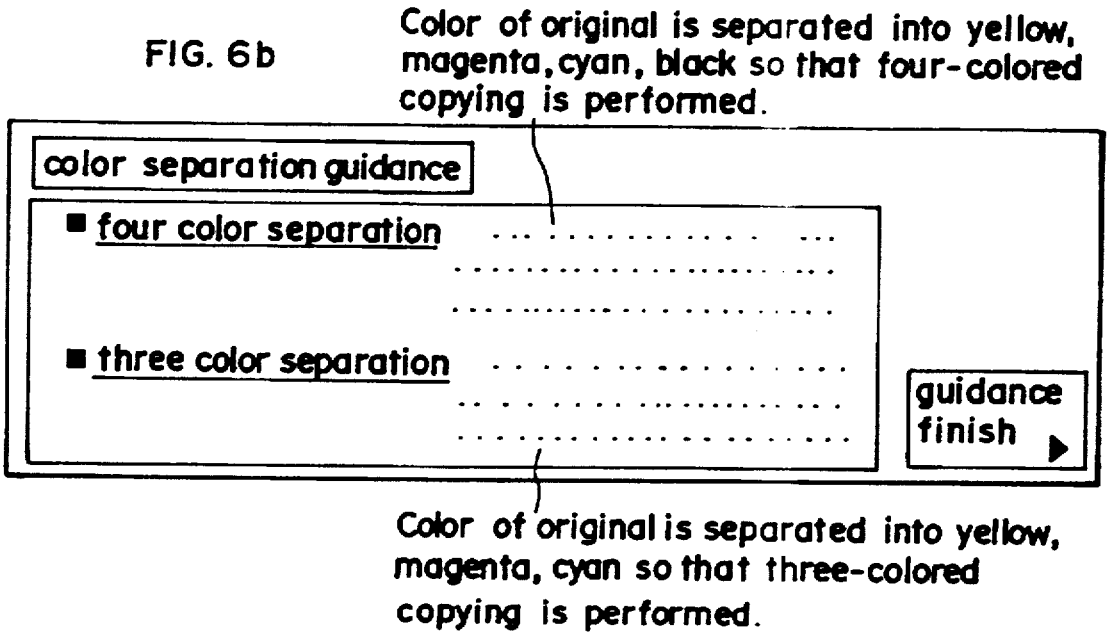
FIG. 6*b* shows an example of a screen for the guidance display 2.
Figure 6C:
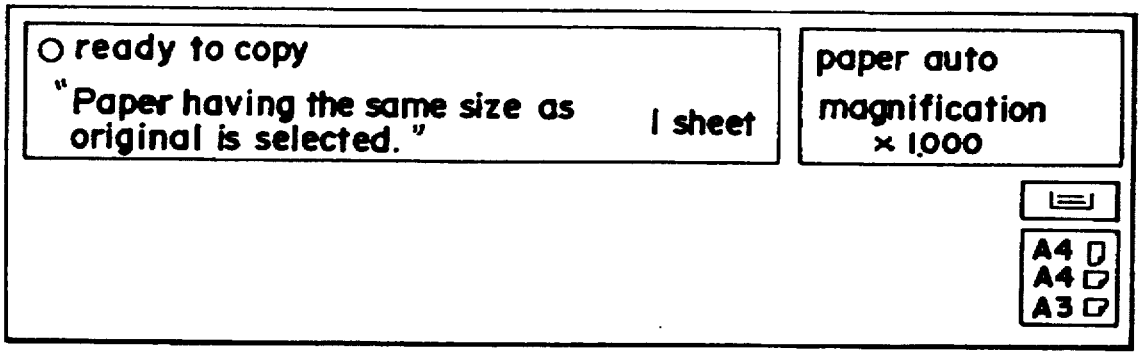
FIG. 6*c* shows an example of a screen for the standard mode.

The differences between the previously mentioned guidance display 1 and guidance display 2 are described below. The guidance displays can be broadly differentiated into simple guidance which simply describes the functions of the various keys, and complex guidance which provides descriptions of special copy functions and mode settings. In the present embodiment of the invention, guidance display 1 is of the aforesaid simple type, and guidance display 2 is of the aforesaid complex type. FIG. 6*a* shows, as an example of guidance display 1, the LCD screen 11 displaying a description of the copy density adjusting mode. FIG. 6*b* shows, as an example of guidance display 2, the LCD screen 11 displaying a description of the color separation mode wherein the color of an original is read by color image sensors to print out each color separately.

Figure 7:
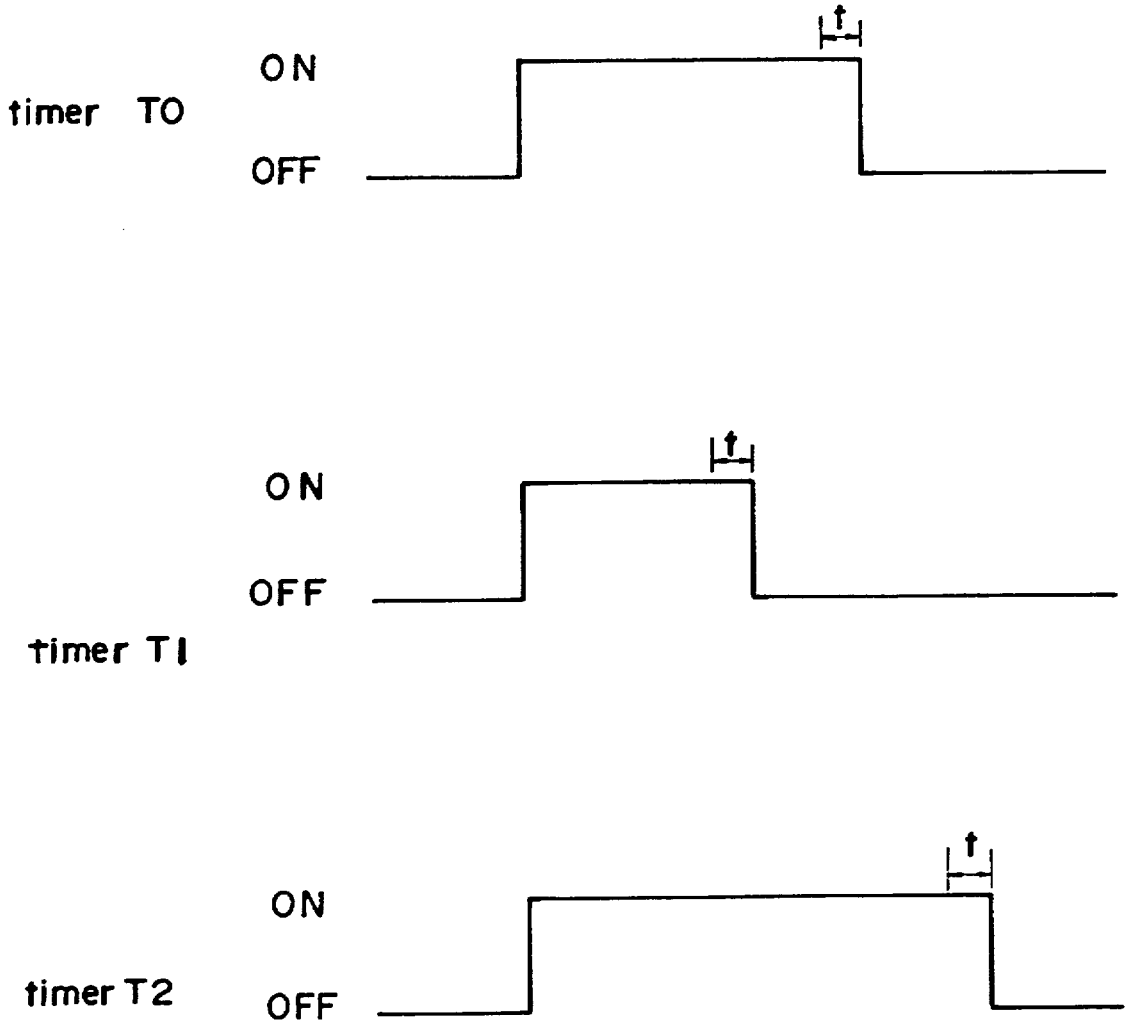
FIG. 7 shows a time chart for the auto-clear timers T0, T1, and T2.

Since the aforesaid guidance display 1 is an extremely simple display, the time required by an operator to read and understand said display is relatively short. Accordingly, the auto-clear timer T1, which counts a period shorter than the normal auto-clear timer T0, is set. On the other hand, Since the guidance display 2 is a complex display, sufficient time is required to allow an operator to read and understand said display. Accordingly, the auto-clear timer T2, which counts a period longer than the normal auto-clear timer T0, is set. The relationship among the aforesaid auto-clear timers T0, T1 and T2 is shown in FIG. 7.

The description continues now referring back to FIG. 5*b*. A check is made in step S30 to determine whether or not any of the auto-clear timers T0, T1 and T2 has finished. When it is determined that an auto-clear timer has finished, a warning display is turned ON in step S31, and a flick timer t is started in step S32. The aforesaid warning display is accomplished via the flickering of the LCD screen 11. In step S33, a check is made to determine whether or not the flick timer t is finished. If the flick timer t has not finished, the routine returns to the main routine, whereas if the flick timer t has finished, the standard mode (refer to FIG. 6*c*) is set in step S34, the warning display is turned OFF in step S35, and the routine returns to the main routine.

The previously mentioned flick timer is described below. The CPU causes the LCD screen 11 to flicker t seconds before the auto-clear timers T0, T1 and T2 are finished, and executes the auto-clear after said flicker has been executed for t seconds. The flick timer t normally is set for a uniform time period relative to the auto-clear timers T0, T1 and T2, as shown in FIG. 7. When a key, e.g., ten-key pad keys 30~39, are depressed while the LCD screen 11 flickers from step S31 through step S35 shown in FIG. 5*b*, the routine advances from step S22 to step S24 of FIG. 5*a*, and the current auto-clear timer is changed to the auto-clear timer T0 which is started to prolong the time period until the auto-clear operation.

Although in the present embodiment the LCD screen 11 flickers as a warning display immediately prior to the operation of the auto-clear function, it is to be noted that an audible warning or the like may be generated from the copying apparatus body as a warning display.

In the present embodiment, the copy conditions are automatically returned to the standard copy conditions via the operation of the auto-clear function, and at the same time the LCD screen 11 may also display automatically the standard mode. However, while the LCD screen 11 automatically displays the standard mode via the operation of the auto-clear function, the copy conditions may be set to the standard conditions when an operator operates the keys.

Furthermore, in the present embodiment, when an operator depresses the guidance key 2, the guidance timer T2, which operates for a timer period longer than the operation time of the auto-clear timer, is operated. However, the copying apparatus auto-clear function may also be prohibited when the guidance key 2 is depressed.

While the auto-clear function operates when the auto-clear timers T1 and T2 are finished in the present embodiment, it should be understood that the guidance mode may be cancelled when the aforesaid timers T1 and T2 finish counting.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus capable of making copies under either predetermined standard copy conditions or copy conditions optionally set by an operator, said image forming apparatus comprising:

first setting means for setting copy conditions other than the standard copy conditions;

first counting means for counting a first predetermined time period after the completion of a copying operation or after copy conditions have been set by the first setting means;

return means for automatically returning the copy conditions to the standard copy conditions when any operation has not been performed by the operator before the first counting means finishes counting;

second setting means for setting a guidance mode for providing an explanation of copy condition setting methods and operating methods to the operator;

display means for displaying the copy condition setting methods and operating methods in accordance with the set guidance mode;

second counting means for counting a second predetermined time period after the guidance mode is set by said second setting means, and wherein said second time period counted by the second counting means is different than the first time period counted by said first counting means; and cancel means for cancelling the guidance mode only when the second counting means finishes counting.

2. An image forming apparatus as claimed in claim 1 wherein said second counting means counts the second time period longer than that counted by the first counting means.

3. An image forming apparatus as claimed in claim 1 wherein said return means is operated when the second counting means finishes counting.

4. An image forming apparatus as claimed in claim 1 wherein said display means further displays the set copy conditions when the guidance mode is not set.

5. An image forming apparatus capable of making copies under either predetermined standard copy conditions or copy conditions optionally set by an operator, said image forming apparatus comprising:

first setting means for setting copy conditions other than the standard copy conditions;

counting means for counting a predetermined time period after the completion of a copying operation or after copy conditions have been set by the first setting means;

return means for automatically returning the copy conditions to the standard copy conditions when any operation has not been performed by the operator before the counting means finishes counting;

second setting means for setting a guidance mode for providing an explanation of copy condition setting methods and operating methods to the operator to enable the operator to execute at the same time the first setting means for setting copy conditions; and prohibiting means for prohibiting the operation of the return means when the guidance mode is set by the second setting means.

6. An image forming apparatus capable of making copies under either predetermined standard copy conditions or copy conditions optionally set by an operator, said image forming apparatus comprising:

setting means for setting copy conditions other than the standard copy conditions;

counting means for counting a first predetermined time period after the completion of a copying operation or after copy conditions have been set by the setting means;

return means for automatically returning the copy conditions to the standard copy conditions when any operation has not been performed by the operator before the counting means finishes counting; and warning means for warning the operator that the return means is about to operate a second predetermined time period before the counting means finishes counting.

7. An image forming apparatus as claimed in claim 6 wherein said warning means includes flicking means for flicking a screen on which the standard copy conditions or other copy conditions set by the operator is displayed.

8. An image forming apparatus as claimed in claim 6 wherein the counting means is restarted counting when the setting means is operated during the counting by the counting means.

9. An image forming apparatus capable of making copies under either a first mode or a second mode, said image forming apparatus comprising:

selecting means for selecting the second mode;

counting means for counting a first predetermined time period after the selection of the second mode;

switching means for automatically switching from the second mode to the first mode when any operation has not been performed before the counting means finishes counting; and warning means for warning an operator that the switching means is about to operate a second predetermined time period before the counting means finishes counting.

10. An image forming apparatus as claimed in claim 9 wherein the first mode is standard copy mode and the second mode is an optical copy mode set by the operator.

11. A method performed in an image forming apparatus having first and second operation modes, said method comprising the steps of:

providing a counter to which a value is set in accordance with the switching of the first and second operation modes;

selecting the second operation mode;

starting the counter; and automatically switching from the second operation mode to the first operation mode in response to the completion of the counting by the counter.

12. A method performed in an image forming apparatus capable of making copies under either a first mode or a second mode, said method comprising the steps of:

selecting the second mode;

counting a first predetermined time period after the selection of the second mode;

warning an operator a second predetermined time period before the completion of the counting; and automatically switching from the second mode to the first mode when any operation has not been performed by an operator after said warning.

13. An image forming apparatus capable of making copies under either predetermined standard copy conditions or copy conditions optionally set by an operator, said image forming apparatus comprising:

first setting means for setting copy conditions other than the standard copy conditions;

first counting means for counting a first predetermined time period after the completion of a copying operation or after copy conditions have been set by the first setting means;

return means for automatically returning the copy conditions to the standard copy conditions when any operation has not been performed by the operator before the counting means finishes counting;

second setting means for setting a guidance mode for explaining the copy condition setting methods and operating methods to the operator;

display means for displaying the copy condition setting methods and operating methods in accordance with the set guidance mode;

second counting means for counting a second predetermined time period after the guidance mode is set by said second setting means, and wherein said second time period counted by the second counting means is longer than the first time period counted by said first counting means; and cancel means for canceling the guidance mode only when the second counting means finishes counting.

14. An image forming apparatus as claimed in claim 13, wherein said return means is operated when the second counting means finishes counting.

15. An image forming apparatus capable of making copies under either predetermined standard copy conditions or copy conditions optionally set by an operator, said image forming apparatus comprising:

first setting means for setting copy conditions other than the standard copy conditions;

first counting means for counting a first predetermined time period after the completion of a copying operation or after copy conditions have been set by the first setting means;

return means for automatically returning the copy conditions to the standard copy conditions when any operation has not been performed by the operator before the counting means finishes counting;

second setting means for setting a guidance mode for explaining the copy condition setting methods and operating methods to the operator;

display means for displaying the copy condition setting methods and operating methods in accordance with the set guidance mode;

second counting means for counting a second predetermined time period after the guidance mode is set by said second setting means, and wherein said second time period counted by the second counting means is different than the first time period counted by said first counting means, wherein said return means is operated when the second counting means finishes counting;

warning means for warning the operator that the return means is about to operate a third predetermined time period before the first counting means or second counting means finishes counting; and cancel means for canceling the guidance mode when the second counting means finishes counting.

16. An image forming apparatus as claimed in claim 15, wherein said display means further displays the set copy conditions when the guidance mode is not set.

17. A method performed in an image forming apparatus having a first operation mode and a and second operation mode, said method comprising the steps of:

providing a counter to which a value is set in accordance with the switching of the first and second operation modes;

selecting the second operation mode;

starting the counter; and automatically switching from the second operation mode to the first operation mode in response to the completion of the counting by the counter, wherein the counter value for the second operation mode is longer than the counter value for the first operation mode.

18. An image forming apparatus capable of making copies under either predetermined standard copy conditions or copy conditions optionally set by an operator, said image forming apparatus comprising:

first setting means for setting copy conditions other than the standard copy conditions;

first counting means for counting a first predetermined time period after the completion of a copying operation or after copy conditions have been set by the first setting means;

return means for automatically returning the copy conditions to the standard copy conditions when any operation has not been performed by the operator before the first counting means finishes counting;

second setting means for setting a guidance mode for providing an explanation of copy condition setting methods and operating methods to the operator;

display means for displaying the copy condition setting methods and operating methods in accordance with the set guidance mode;

second counting means for counting a second predetermined time period after the guidance mode is set by said second counting means, and wherein said second time period counted by the second counting means is different than the first time period counted by said first counting means and said return means is operated when the second counting means finishes counting;

various means for warning the operator that the return means is about to operate a third predetermined time period before the first counting means and the second counting means finishes counting; and cancel means for cancelling the guidance mode when the second counting means finishes counting.

19. An image forming apparatus capable of making copies under either predetermined standard copy conditions or copy conditions optionally set by an operator, said image forming apparatus comprising:

first setting means for setting copy conditions other than the standard copy conditions;

first counting means for counting a first predetermined time period after the completion of a copying operation or after copy conditions have been set by the first setting means;

return means for automatically returning the copy conditions to the standard copy conditions when any operation has not been performed by the operator before the counting means finishes counting;

second setting means for setting a guidance mode for explaining the copy condition setting methods and operating methods to the operator;

display means for displaying the copy condition setting methods and operating methods in accordance with the set guidance mode;

second counting means for counting a second predetermined time period after the guidance mode is set by said second setting means, and wherein said second time period counted by the second counting means is longer than the first time period counted by said first counting means and said return means is operated when the second counting means finishes counting;

warning means for warning the operator that the return means is about to be operated a third predetermined time period before the first counting means or second counting means finishes counting; and cancel means for cancelling the guidance mode when the second counting means finishes counting.

20. An image forming apparatus capable of making copies under either predetermined standard copy conditions or copy conditions optionally set by an operator, said image forming apparatus comprising:

first setting means for setting copy conditions other than the standard copy conditions;

first counting means for counting a first predetermined time period after the completion of a copying operation or after copy conditions have been set by the first setting means;

return means for automatically returning the copy conditions to the standard copy conditions when any operation has not been performed by the operator before the counting means finishes counting;

second setting means for setting a guidance mode for explaining the copy condition setting methods and operating methods to the operator;

display means for displaying the copy condition setting methods and operating methods in accordance with the set guidance mode and further displaying the set copy conditions when the guidance mode is not set;

second counting means, for counting a second predetermined time period after the guidance mode is set by said second setting means, and wherein said second time period counted by the second counting means is longer than the first time period counted by said first counting means; and cancel means for cancelling the guidance mode when the second counting means finishes counting.

21. An image forming apparatus capable of making copies under either predetermined standard copy conditions or copy conditions optionally set by an operator, said image forming apparatus comprising:

copy setting means for setting copy conditions other than standard copy conditions;

guidance setting means for setting a guidance mode for providing an explanation of the copy condition setting methods and operating methods to the operator;

display means for displaying the copy condition setting methods and operating methods in accordance with the set guidance mode;

first timer for counting a first predetermined time period after the completion of a copying operation or after copy conditions have been set by the copy setting means;

second timer for counting a second predetermined time period which is different from the first predetermined time period after the completion of a copying operation or after copy conditions have been set by the copy setting means; and return means for automatically returning the copy conditions set by the copy setting means to the standard copy conditions in response to a time-up of the first timer when the guidance mode is not set, and autom returning the copy conditions set by the copy setting means to the standard copy conditions in response to a time-up of the second timer when the guidance mode is set.

22. An image forming apparatus as claimed in claim 21 wherein said second predetermined time period is longer than said first predetermined time period.

23. An image forming apparatus as claimed in claim 21, further comprising warning means for warning the operator that the return means is about to operate a third predetermined time period before the time-up of the first timer or the second timer.

24. An image forming apparatus as claimed in claim 21 wherein said display means further displays the set copy conditions when the guidance mode is not set.

* * * * *